US006004918A

United States Patent [19]

Adams

[11] Patent Number: 6,004,918

[45] Date of Patent: Dec. 21, 1999

[54] LIQUID DETERGENTS CONTAINING DEFOAMER COMPOSITIONS AND DEFOAMER COMPOSITIONS SUITABLE FOR USE THEREIN

[75] Inventor: William Kiger Adams, Tecumseh, Mich.

[73] Assignee: Wacker Silicones Corporation, Adrian, Mich.

[21] Appl. No.: 09/173,773

[22] Filed: Oct. 16, 1998

[51] Int. Cl.[6] ..... C11D 7/10; C11D 7/14; C11D 7/26; C11D 7/50

[52] U.S. Cl. ..... 510/353; 510/437; 510/337; 510/466; 510/481; 510/485; 516/117; 516/118; 516/123; 516/124

[58] Field of Search ..... 510/337, 353, 510/437, 466, 481, 485; 516/117, 118, 123, 124

[56] References Cited

U.S. PATENT DOCUMENTS

| | | | |
|---|---|---|---|
| 1,947,725 | 2/1934 | Macarthur | 516/132 |
| 2,668,150 | 2/1954 | Luvisi | 516/134 |
| 3,086,944 | 4/1963 | Dusseldorf | 516/134 |
| 3,933,672 | 1/1976 | Bartolotta et al. | 510/438 |
| 3,957,705 | 5/1976 | Gärtner et al. | 524/221 |
| 4,082,689 | 4/1978 | Heyden et al. | 516/123 |
| 4,087,398 | 5/1978 | Heyden et al. | 524/362 |
| 4,230,599 | 10/1980 | Elfers | 451/163 |
| 4,341,656 | 7/1982 | Abel | 516/125 |
| 4,384,976 | 5/1983 | Grünert et al. | 516/124 |
| 4,477,371 | 10/1984 | Huber et al. | 516/121 |
| 4,686,060 | 8/1987 | Crabtree et al. | 510/347 |
| 4,769,170 | 9/1988 | Omori et al. | 510/170 |
| 4,919,843 | 4/1990 | Innertsberger | 516/117 |
| 5,238,596 | 8/1993 | Smith | 510/441 |
| 5,643,862 | 7/1997 | Jones et al. | 510/466 |
| 5,648,327 | 7/1997 | Smerznak et al. | 510/340 |
| 5,695,575 | 12/1997 | Angevaare et al. | 134/25.2 |

*Primary Examiner*—Yogendra Gupta
*Assistant Examiner*—Gregory R. DelCotto
*Attorney, Agent, or Firm*—Brooks & Kushman P.C.

[57] ABSTRACT

Liquid foam control compositions provide good control for liquid detergent formulations, while being storage stable both before and after incorporation into liquid detergent.

12 Claims, No Drawings

LIQUID DETERGENTS CONTAINING DEFOAMER COMPOSITIONS AND DEFOAMER COMPOSITIONS SUITABLE FOR USE THEREIN

TECHNICAL FIELD

The present invention pertains to liquid detergent formulations containing organopolysiloxane defoamers, and to defoamer compositions suitable for use therein.

DESCRIPTION OF THE RELATED ART

Detergent compositions are formulated both for cleaning efficiency and consumer preference. For example, for liquid hand dishwashing compositions consumers perceive detergents which exhibit large amounts of foam as superior in cleaning efficiency, whereas in reality, efficiency and foam level are not directly related. For laundry and machine dishwashing detergents, perception is not involved in these generally closed systems. More importantly, in these systems, foam inhibits the cleaning action, and even moderate foaming results in measurable decreases in agitator speeds and pumping efficiency. Thus, to counteract the natural tendency towards foaming, detergent formulations for laundry and machine dishwashing often contain defoamers to control the foaming of the surfactants. Defoamers for these and other purposes have been used for many years, as evidenced by U.S. Pat. No. 1,947,725 which issued in 1934.

Defoamers are surfactants which are active at the liquid-air interface, and whose activity results in lowering the amounts of foam which would otherwise be present. While there are numerous defoamers which have been used in the past, organopolysiloxane defoamers have long been recognized as one of the most efficient classes of defoamers. While silicone oils such as trimethylsilyl-terminated polydimethylsiloxanes have been used in some systems as effective defoamers, such products are generally not suitable, in and of themselves, for use in detergent formulations. Rather, more complex defoamers such as those disclosed in U.S. Pat. Nos. 4,477,371 and 4,919,843 have been used. In such compositions, trimethylsilyl-or dimethylsilanolyl-terminated organopolysiloxanes are reacted with hydrophilic silica at elevated temperature for relatively long lengths of time. The active compounds are mixed with surfactants and an ester-type solvent to form readily dispersible compositions.

However, to be suitable as a defoamer, the defoamer must also be stable in the detergent composition. For example, U.S. Pat. No. 3,933,672 attests to the loss of efficiency of silicone defoamers during storage through interaction with detersive surfactants in dry detergent formulations. In these dry detergents, not even silicone defoamers absorbed in porous carriers were indicated as acceptable. Rather, according to the '672 patentees, silicone defoamers must first be encapsulated by a water soluble carrier which dissolves upon contacting water, liberating the foam control agent. Encapsulation is a relatively expensive mode of isolating the defoamers.

In U.S. Pat. No. 4,686,060, granular machine laundry detergent formulations employ suds control prills made of a fatty acid soap, quaternary ammonium salt, and silicone fluid. The defoamer "prills" may be flakes or granules, or prills in its customary usage.

In U.S. Pat. No. 5,238,596, foam control agents suitable for use in powder detergents are prepared from silicone antifoam, a water insoluble fatty acid or fatty alcohol having a melting point between 40° C. and 80° C., and a native starch carrier material. The foam control agents are prepared by combining silicone and molten fatty compound followed by contacting droplets of the resulting composition, emanating from a spray head, with starch in a fluidized bed coater.

The problems of maintaining foam control stability in dry detergent formulations are formidable, and in liquid detergent formulations, unique problems occur as well. For example, the encapsulated defoamers of U.S. Pat. No. 3,933,672 cannot survive in liquid formulations because the encapsulant is water soluble. The fatty acid soap-containing prills of U.S. Pat. No. 4,686,060 are soluble also, allowing the silicone defoamer to contact harsh detergents, builders, bleaches, etc., as is also true of the starch-coated defoamers of U.S. Pat. No. 5,238,596.

In U.S. Pat. No. 5,643,862, organopolysiloxane defoamers showed surprising storage stability when first blended with a substantially water-free non-ionic surfactant (<0.1% water) to which is added finely divided hydrophobic silica. The organopolysiloxane defoamers themselves are the admixture or reaction product of an organopolysiloxane and silanated silica particles. The '862 patent also attests to a further problem with liquid detergents not found in dry formulations: the propensity of the components of such formulations to separate upon storage. Similar compositions are disclosed in U.S. Pat. No. 5,648,327, which further indicates that a narrow silicone particle size range is necessary to provide good foam control. However, some separation of formulation ingredients occurred after only nine days of storage.

It would be desirable to provide organopolysiloxane foam control compositions which are stable both with respect to interactions with liquid detergent composition components as well as exhibiting freedom from separation in both the detergent as well as in the foam control compositions themselves. It would be further desirable to provide silicone foam control compositions which are self emulsifying, and which provide silicone dispersed phases which provide for effective defoaming action.

SUMMARY OF THE INVENTION

It has now been surprisingly discovered that highly effective organopolysiloxane defoamers comprise a dispersion of organopolysiloxane and specific metal carboxylates, together with an optional surfactant component, in a water-immiscible organic solvent. The defoamer compositions are self-emulsifying, and exhibit marked freedom from separation in liquid detergent formulations.

DESCRIPTION OF THE PREFERRED EMBODIMENTS

The organopolysiloxane defoamers are those which exhibit defoaming ability in detergent formulations when the latter are used for cleaning operations in aqueous environments. The organopolysiloxanes may, for example, be polyorganosiloxanes whose major repeating moieties are $$R_2SiO_{2/2}$$

in which each R individually is generally a $C_{1-18}$ alkyl group, preferably a $C_{1-4}$ alkyl groups most preferably a methyl group. Such organopolysiloxanes may be terminated with trialkylsilyl groups, dialkylsilanolyl groups (e.g., α,ω-dihydroxyorganopolysiloxanes), vinyldimethylsilyl groups, and the like. While the hydrocarbon substituents may be substituted, for example by halogens, cyano groups, alkoxy groups, poly(alkyleneoxy) groups and the like, organopolysiloxanes wherein the majority of R groups are methyl groups are preferred due to their ready availability and lower cost.

In addition to the dialkylsiloxy repeating units previously described, the defoamer organopolysiloxane may also contain $RSiO_{3/2}$, and $SiO_{4/2}$ moieties, the so-called T and Q units, which provide branched and crosslinked structures The organopolysiloxanes may have interspersed or pendant polyoxyalkylene groups i.e., are polyorganosiloxane polyether surfactants. Some preferred defoamers contain long chain alkyl groups such as decyl, octadecyl and other relatively hydrophobic groups.

Preferred defoamers may be prepared by reacting silanol-functional organopolysiloxanes or alkyl-terminated organopolysiloxanes such as α,ω-dihydroxypolydimetnylsiloxanes and α,ω-trimethylsiloxy polydimethylsiloxanes with finely divided silica particles, preferably particles bearing free hydroxyl groups. The reaction may take place as described in U.S. Pat. Nos. 4,477,371 and 4,919,843, herein incorporated by reference. Substantially any dispersible water-insoluble silicone may be used as the silicone ingredient of the defoamer compositions herein. Suitable defoamers are available from Wacker Silicones such as S-132, S-1132 defoamers, and Pulpsil® 160C. siloxane and 22176 VP antifoam compound.

The water immiscible organic solvent is also one in which the organopolysiloxane defoamer is largely or wholly insoluble, in the amounts used, in conjunction with other defoamer composition components. Mixtures of organic solvents may be used as well. All organic solvents meeting the above requirements which do not suppress the foam control ability of the organopolysiloxane are, in principle, suitable, including aliphatic and aromatic solvents (naphthas), mineral spirits, turpentine, alkanol esters, and the like. By "immiscible" is meant that a substantial quantity of solvent will not dissolve in the aqueous phase in the quantities used. Some solubility is acceptable.

Preferred water immiscible solvents are liquid hydrocarbons bearing one or more relatively hydrophobic groups consisting of $C_4$ or greater, i.e., $C_5$–$C_{18}$ alkyl, alkylene or alkylidene radicals, and at least one relatively polar organic functional group, non-limiting examples of which are

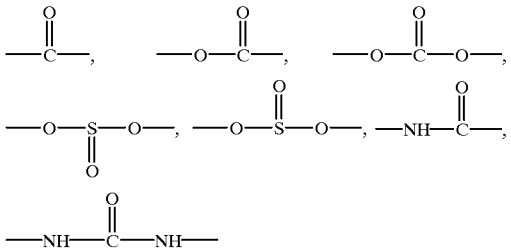

and the like.

Most preferred, however, are aliphatic aliphatic monoalkyl esters and dicarboxylic acid diesters and the like, such as the methyl and ethyl esters of $C_4$–$C_8$ dicarboxylic acids, preferably $C_4$–$C_6$ dicarboxylic acids. A preferred organic solvent is Eastman TXIB. The organic solvent or solvent mixture must also be a non-solvent for the metal carboxylate components at room temperature and desirably has a high flash point as well. Aromatic dicarboxylic acid diesters are also useful.

A surfactant is an optional ingredient of the formulation. Preferably, the surfactant is one having an HLB greater than 6, which is ineffective in maintaining the organopolysiloxane in solution in the organic solvent, i.e., one which facilitates dispersion of the organopolysiloxane in the solvent. The surfactant is preferably one which causes the silicone and organic solvent to be readily emulsified to form oil-in-water emulsions upon addition to aqueous detergent use solutions, such as may be found in clothes washers and machine dishwashers. In some cases, the organopolysiloxane foam control agent may be dispersible in the organic solvent without the need for a surfactant, as more fully described hereinafter, and is emulsified when added to the detergent formulation by the surfactants in the detergent. In such cases, no surfactant may be necessary in the foam control composition. Surfactants which cause the organopolysiloxane to go into solution or remain in solution in the water immiscible organic solvent, or which form a microemulsion of organopolysiloxane with particle sizes of less than about 1 μm are not suitable surfactants.

Numerous surfactants are useful. A list of possible surfactants may be found in U.S. Pat. No. 5,643,862, herein incorporated by reference. However, a preferred surfactant is the hexaoleate of diglycerine, available from ICI America, and known as Atlox®G-1086, The surfactants are preferably at least partially soluble in the water immiscible organic solvent, for example in amounts of at least one percent by weight relative to the weight of solvent and organopolysiloxane. The combination of water immiscible organic solvent, organopolysiloxane, and optional surfactant and/or non-solvent, as described below, should preferably produce, upon addition of the detergent to water, organopolysiloxane defoamer particles in the size range of 3 μm to 100 μm, preferably 5 μm to 100 μm.

Additional surfactants include the following:

1. Alkyl sulfates, in particular those having a chain length of from 8 to 18 carbon atoms, alkyl and alkaryl ether sulfates having from 8 to 18 carbon atoms in the hydrophobic radical and from 1 to 40 ethylene oxide (EO) or propylene oxide (PO) units,
2. Sulfonates, particularly alkylsulfonates having from 8 to 18 carbon atoms, alkylarylsulfonates having from 8 to 18 carbon atoms, taurides, esters and half-esters of sulfosuccinic acid with monohydric alcohols or alkylphenols having from 4 to 15 carbon atoms, these alcohols or alkylphenols also optionally ethoxylated with from 1 to 40 EO units.
3. Alkali metal and ammonium salts of carboxylic acids having from 8 to 20 carbon atoms in the alkyl, aryl, alkaryl or aralkyl radical.
4. Phosphoric acid partial esters and their alkali metal and ammonium salts, particularly alkyl and alkaryl phosphates having from 8 to 20 carbon atoms in the organic radical, alkyl ether and alkaryl ether phosphates having from 8 to 20 carbon atoms in the alkyl or alkaryl radical respectively and from 1 to 40 EO units.

Examples of nonionic emulsifiers are:

5. Polyvinyl alcohol which still has from 5 to 50%, preferably from 8 to 20%, of vinyl acetate units, having a degree of polymerization of from 500 to 3000.
6. Alkyl polyglycol ethers, preferably those having from 8 to 40 EO units and alkyl radicals having from 8 to 20 carbon atoms.
7. Alkylaryl polyglycol ethers, preferably those having from 8 to 40 EO units and from 8 to 20 carbon atoms in the alkyl and aryl radicals,
8. Ethylene oxide-propylene oxide (EO/PO) block copolymers, preferably those having from 8 to 40 EO and PO units.

9. Addition products of alkylamines whose alkyl radicals have from 8 to 22 carbon atoms with ethylene oxide or propylene oxide.
10. Fatty acids having from 6 to 24 carbon atoms.
11. Alkyl polyglycosides of the general formula R*—O—$Z_o$, in which R is a linear or branched, saturated or unsaturated alkyl radical having on average 8–24 carbon atoms, and $Z_o$ is an oligoglycoside radical having on average o=1–10 hexose or pentose units or mixtures thereof.
12. Natural substances and their derivatives, such as lecithin, lanolin, saponins, and cellulose alkyl ethers and carboxyalkylcelluloses, the alkyl groups of which in each case have up to 4 carbon atoms.
13. Linear organo(poly)siloxanes containing polar groups, in particular those containing alkoxy groups having up to 24 carbon atoms and/or up to 40 EO and/or PO groups.

Examples of cationic emulsifiers are:

14. Salts of primary, secondary and tertiary fatty amines having from 8 to 24 carbon atoms with acetic acid, sulfuric acid, hydrochloric acid and phosphoric acids.
15. Quaternary alkyl and alkylbenzene ammonium salts, in particular those whose alkyl group has from 6 to 24 carbon atoms, in particular halides, sulfates, phosphates and acetates.
16. Alkylpyridinium, alkylimidazolinium and alkyloxazolinium salts, in particular those whose alkyl chain has up to 18 carbon atoms, especially halides, sulfates, phosphates and acetates.

Examples of ampholytic emulsifiers are.

17. Long-chain substituted amino acids, such as N-alkyl-di (aminoethyl)glycine or N-alkyl-2-aminopropionic acid salts.
18. Betaines such as N-(3-acylamidopropyl)-N,N-dimethylammonium salts having a $C_8$–$C_8$-acyl radical and alkylimidazolium betaines.

In some formulations, addition of an organic liquid which is soluble in the water immiscible organic solvent and which is a poorer solvent or a non-solvent for the organopolysiloxane foam control agent may also be useful. In general, such "non-solvents" should have a molecular weight lower than that of the organopolysiloxane, but non-solvents with higher molecular weights may also be suitable in some applications. The non-solvent, when added to the mixture of water-immiscible organic solvent and organopolysiloxane foam control agent should cause the latter to come out of solution and form a dispersed phase, as is the case with the surfactants useful herein. The non-solvent may be used together with a surfactant in some formulations. An examples of a non-solvent is diethylphthalate. To test a particular non-solvent for its suitability in the subject formulations, an initial screening test may be performed wherein the candidate non-solvent is added to the mixture of water-immiscible organic solvent and organopolysiloxane or to the mixture of water immiscible solvent, metal carboxylate, and organopolysiloxane, and the difference in solubility of organopolysiloxane assessed visually or by physical methods. Candidate non-solvents generally cause dissolved organopolysiloxane to become a dispersed phase having particle sizes greater than 1 $\mu$m, and preferably greater than 3–5 $\mu$m.

Hydrophilic or hydrophobic silicas, preferably hydrophobic silica, are preferred ingredients These silicas may be present with the metal carboxylate in a ratio of 0:1 to about 10:1, preferably 0:1 to about 5:1. Greater amounts of silica may be useful in some formulations. The silica is used both to provide enhanced dispersion stability as well as to modify the specific gravity of the defoamer to more closely match the specific gravity of the detergent continuous phase. By "hydrophilic silica" and "hydrophobic silica" is meant silica which is separately added to the foam control composition. These terms do not encompass silica which may already be present as a component or reaction product in the silicone foam control agent.

A metal carboxylate is a necessary ingredient of the subject invention defoamer compositions. By the term "metal carboxylate" is meant a non-liquid fatty acid salt of zinc, magnesium, calcium, or aluminum. The fatty acid component of the salt may contain from eight to about thirty carbon atoms, and may be saturated or unsaturated. Preferred fatty acids are resin acids, tall oil acids, montan acids, naphthenic acids, and in particular, the carboxylic acids derived from animal and vegetable sources such as by saponification of naturally occurring triglycerides, e.g., linolenic acid, linoleic acid, palmitic acid, oleic acid, stearic acid, and the like. Palmitic acid and stearic acid are preferred fatty acids, with stearic acid most preferred The metal carboxylates must be at least partially insoluble, and preferably substantially insoluble in the organic solvent phase such that a dispersion of metal carboxylate in solvent may be obtained. Preferably, the metal carboxylate is soluble, in the quantities used, in the organic solvent at elevated temperature, but of only limited solubility or virtually insoluble at room temperature. The metal carboxylates are virtually insoluble in water, the aqueous solubility being less than about 0.1 g/l.

The metal carboxylates also must have a density less than 1.5 g/cm$^3$, and preferably less than 1.2 g/cm$^3$ Densities in the range of 0.95 to 1.1 g/cm$^3$ are preferred. The metal carboxylate may be used as the compound itself, or as an addition compound, i.e., a hydrate or other complex. Particularly preferred are aluminum carboxylates such as aluminum stearate and aluminum palmitate, most particularly aluminum stearate.

Preferred compositions contain minimally about 60 weight percent water immiscible organic solvent, and more preferably at least 70 weight percent; and maximally about 90 weight percent water immiscible organic solvent, more preferably maximally about 85 weight percent. Organopolysiloxane defoamer is present in amounts of at least 1 weight percent, more preferably at least 3 weight percent, and most preferably 5 weight percent or more, and in general not more than 25 weight percent, preferably not more than 15 weight percent, and more preferably not more than 10 weight percent Metal carboxylate is present minimally in amounts of 0.2 weight percent, more preferably 0.4 weight percent or more, and most preferably 0.5 weight percent or more, with the upper limit being generally less than 3 weight percent, more preferably less than 2.6 weight percent, and most preferably less than 1.5 weight percent.

The optional surfactant, when present, is present in amounts of, for example, 5 weight percent or more, preferably 8 weight percent or more, and generally less than 20 weight percent, more preferably less than 15 weight percent, and in particular less than 10 weight percent. The optional silica, when present, may be present in amounts of up to 3 weight percent, preferably up to about 1.9 weight percent. It is preferably in many formulations that the minimum silica content is about 0.6 weight percent or more. The amount of silica is, of course, dependent upon the density of the detergent, with more dense detergent compositions generally requiring more silica. The resulting compositions should be stable, i.e., should show no marked tendency to separate after two weeks storage at room temperature. The non-solvent, when present, may be present in amounts of up to 90 percent by weight, preferably up to 60 percent by weight, and most preferably up to 20 percent by weight, these weight percents based on the total weight of water immiscible organic solvent and non-solvent.

The defoamers may be prepared by any method which results in a homogenous and optionally self-emulsifying composition. However, it has proven advantageous to first dissolve the metal carboxylate in the organic solvent at elevated temperatures and allow the metal carboxylate to precipitate out upon cooling. At the beginning of the precipitation of metal carboxylate, hydrophobic silica is optionally added, and the mixture further cooled, and then treated in a homogenizer or three roll mill or the like, to prepare a fine dispersion of the metal carboxylate and optional hydrophobic silica in the organic solvent.

The silicone defoamer component may be added prior to homogenization as described above, or may be post added. Following homogenization, additional solvent may be added to achieve the desired final silicone level, for example 1 to 25 weight percent, preferably 5–15 and more, preferably about 7.5 weight percent. The surfactant, or non-solvent, when used, is then added, at which point silicone will generally precipitate from the solvent as a dispersion. Prior to addition of surfactant, the compositions are preferably somewhat gel-like, due to the presence of a gel-promoting metal carboxylate. Thus, the preferred defoamer compositions are liquid-liquid dispersions of silicone in organic solvent and liquid-solid dispersions of metal carboxylate and hydrophobic silica in organic solvent. The various phases are not necessarily distinct, due to the interactions possible and the presence of considerable surfactant. For example, the solid phases may be concentrated at the liquid-liquid interfaces.

The liquid foam control additives of the subject invention are added to liquid detergent formulations by standard techniques. The addition may take place before or while other ingredients in the liquid detergent are being added, or may take place following preparation of the base liquid detergent formulation. The amount of defoamer composition present in the liquid detergent will, of necessity, vary with the detergent ingredients. For example, those detergents containing high foaming surfactants will require greater amounts of defoamer composition than detergents whose content of high foamers is low or zero. The concentration generally ranges from about 0.05 weight percent to 3.0 weight percent, preferably 0.10 weight percent to 2.0 weight percent and most preferably about 0.25 weight percent to about 1.0 weight percent, these weight percents being based on the total weight of finished detergent, i.e., detergent containing the foam control agent and other ingredients such as water, surfactants, bleaching agents, builders, perfumes, dyes, etc.

Having generally described this inventions a further understanding can be obtained, by reference to certain specific examples which are provided herein for purposes of illustration only and are not intended to be limiting unless otherwise specified.

Comparative Example C1

A foam control agent composition is prepared employing the following composition:

| Component | Weight Percent |
|---|---|
| Silicone A[1] | 7.5 |
| Eastman ® TXIB ® Solvent | 76.5 |
| Aerosil ® R-202 hydrophobic silica | 3.0 |
| HDK ® H-18 hydrophobic silica | 3.0 |
| Atlox ® G-1086 surfactant | 10.0 |

[1]Silicone A is a commercial silicone defoamer designated S-1132, available from Wacker Silicones, Adrian, Michigan.

The foam control agent C1 is added to a liquid laundry detergent formulation and is found to induce acceptable defoaming characteristics. However, after only a short period of time, considerable sedimentation of the foam control agent is evident at the bottom of the detergent formulation. Such limited stability is not tolerable in commercial formulations.

Comparative Example C2

A foam control agent similar to that of Comparative Example C1, but containing no hydrophobic silica, is prepared. After only ca. 10 days storage of a 150 g sample in an 8 oz. glass wide mouth jar at room temperature, considerable separation of the foam control agent is observed, with a 1.2 cm band of cloudy phase on the bottom, and 3.5 cm of cloudy yellow phase on top. A foam control agent which itself separates upon storage so rapidly cannot be used as a foam control additive in liquid detergent formulations.

Comparative Example C3

A foam control agent is prepared similar to that of Comparative Example C1, but with only 3 weight percent of surfactant, and no hydrophobic silica. Unlike the compositions of Comparative Example C2, no separation is observed upon storage. However, upon addition to a liquid detergent formulation, suds control is inferior to the formulation of Comparative Example C1.

EXAMPLE 1

A foam control agent similar to that of Comparative Example C1 is prepared, except that only 1.4 weight percent hydrophobic silica (Aerosil® R-202) is used, and 1.3 weight percent of aluminum stearate metal carboxylate is added, the mixing of the ingredients following the procedure described previously herein. The foam control additive composition exhibits acceptable suds control when added at levels of 0.5 weight percent to liquid laundry detergent formulation, and is free from separation over a considerable storage period. Moreover, the foam control additive itself is free from segregation during storage.

EXAMPLE 2

A foam control formulation was prepared substantially the same as that of Example 1, however the foam control siloxane S-1132 was replaced with a lower viscosity foam control compound designated S-132, available from Wacker Silicones, Adrian, Mich., and the amount of surfactant was lowered to 7.5 weight percent. The foam control composition performed substantially the same as that of Example 1 when added to a liquid detergent formulation,

EXAMPLE 3

A foam control composition was prepared as in Example 2, but the amount of surfactant was further lowered to 5.0 weight percent. The foam control composition showed greater storage stability than that of Example 2, and also exhibited somewhat greater stability when added to the liquid detergent formulation, while having similar foam control ability.

By the term "major" if used herein is meant 50% or more by weight, or by mol where indicated By the term "minor" is meant less than 50% on the same basis. The invention disclosed herein may be practiced with only the necessary ingredients to the exclusion of one or more or all ingredients listed as optional or not discussed herein. Necessary ingredients include organic solvent, metal carboxylate, and silicone antifoam agent. Preferred optional ingredients include surfactant and additional silica. The invention may also be practiced with any combination of particular named ingredients to the exclusion of other named ingredients.

Having now fully described the invention, it will be apparent to one of ordinary skill in the art that many changes and modifications can be made thereto without departing from the spirit or scope of the invention as set forth herein.

What is claimed is:

1. In a liquid detergent formulation employing one or more foam control additives, the improvement comprising selecting as at least one of the one or more foam control additives, a stable, liquid foam control additive comprising:

a) a water immiscible organic solvent which is an aliphatic mono- or dicarboxylic acid alkyl ester;

b) from about 1 to about 25 weight percent of a siloxane defoamer;

c) from about 0.2 to about 3.0 weight percent of a water insoluble metal fatty carboxylate having a density of less than 1.5 g/cm$^3$, the metal fatty carboxylate at least partially insoluble in the organic solvent at room temperature in the amount used, the metal selected from the group consisting of zinc, calcium, magnesium, and aluminum;

d) from about 0.6 to about 3 weight percent of silica; and e) optionally up to about 20 weight percent of one or more surfactants, wherein the weight percents are based on the total weight of the liquid foam control additive, and wherein the weight ratio of silica to metal carboxylate is up to 10:1.

2. The liquid detergent of claim 1 wherein the liquid foam control additive comprises:

b) from about 3 to about 15 weight percent of the liquid siloxane defoamer;

c) from 0.4 to about 2.6 weight percent of the metal fatty carboxylate;

d) from about 0.6 to about 1.9 weight percent silica; and e) from about 5 weight percent to about 15 weight percent surfactant.

3. The detergent of claim 1 wherein the metal fatty carboxylate comprises a metal palmitate or metal stearate.

4. The detergent of claim 1 wherein the metal fatty carboxylate comprises a metal palmitate or metal stearate.

5. The detergent of claim 1 wherein the metal fatty carboxylate comprises aluminum stearate or aluminum palmitate.

6. The detergent of claim 1 wherein the foam control additive further comprises an organic liquid which is a non-solvent for the siloxane defoamer.

7. The detergent of claim 1 wherein the silica comprises hydrophobic silica.

8. A liquid foam control additive suitable for use in liquid detergent formulations, the liquid foam control additive comprising:

a) a water immiscible organic solvent which is an aliphatic mono- or dicarboxylic acid alkyl ester;

b) from about 1 to about 25 weight percent of a liquid siloxane defoamer;

c) from about 0.2 to about 3 weight percent of a water insoluble metal fatty carboxylate having a density of less than 1.5 g/cm$^3$, the metal fatty carboxylate at least partially insoluble in the organic solvent at room temperature in the amount used, the metal selected from the group consisting of zinc, calcium, magnesium, and aluminum;

d) from about 0.6 to about 3 weight percent of silica; and e) up to about 20 weight percent of one or more surfactants, wherein the weight percents are based on the total weight of the liquid foam control additive.

9. The liquid foam control additive of claim 8 wherein the liquid foam control additive comprises:

b) from about 3 to about 15 weight percent of the liquid siloxane defoamer;

c) from 0.4 to about 2.6 weight percent of the metal fatty carboxylate;

d) from about 0.6 to about 1.9 weight percent silica; and e) from about 5 weight percent about 15 weight percent surfactant.

10. The liquid foam control additive of claim 8 wherein the metal fatty carboxylate comprises a metal palmitate or metal stearate.

11. The liquid foam control additive of claim 8, further comprising an organic liquid which is different from the water immiscible organic solvent and which is a non-solvent for the siloxane defoamer.

12. The liquid foam control agent of claim 8 wherein the silica comprises hydrophobic silica.

* * * * *